United States Patent [19]

Tedei

[11] Patent Number: 4,815,492

[45] Date of Patent: Mar. 28, 1989

[54] FLOOD CONTROL SYSTEM

[75] Inventor: Thomas C. Tedei, Edgewater, Fla.

[73] Assignee: Today Manufacturing Co., Inc., Bellwood, Ill.

[21] Appl. No.: 162,019

[22] Filed: Feb. 29, 1988

[51] Int. Cl.[4] ..... E03B 5/02

[52] U.S. Cl. ..... 137/362

[58] Field of Search ..... 137/115, 362

[56] References Cited

U.S. PATENT DOCUMENTS

| | | | |
|---|---|---|---|
| 2,347,544 | 4/1944 | De Costa | 137/362 X |
| 2,421,066 | 5/1947 | Howe | 137/362 X |
| 2,431,640 | 11/1947 | Gordon | 137/362 X |
| 2,718,238 | 9/1955 | Simko . | |
| 2,739,662 | 3/1956 | Sofia | 137/362 X |
| 3,017,895 | 1/1962 | Portner | 137/115 |
| 3,020,922 | 2/1962 | Oury | 137/362 X |
| 3,115,890 | 12/1963 | Greenbaum . | |
| 3,811,463 | 5/1974 | Dickens | 137/362 |
| 4,019,304 | 4/1977 | Timm . | |

OTHER PUBLICATIONS

Drawing #87500; "Todays Flood Control System"; 12/7/87.

*Primary Examiner*—Robert G. Nilson

*Attorney, Agent, or Firm*—Charles F. Meroni, Jr.

[57] ABSTRACT

A flood control system for use with a building sewer line connected from a building to a city sewer line to prevent back flow of sewage in the line into the building during a flood which includes an underground tank installed in an in-line position with respect to the city sewer line and with at least a portion of the tank lying in a plane below the building sewer line. The city sewer line is cement encased at its point of juncture with the building sewer line beneath the building. The tank has a fluid pump mounted therein and connected by an overhead standpipe for pumping waste fluids from the bottom of the tank back into an inner sewer line for discharge exteriorally to a city sewer line. The tank further has a manually operable gate valve mounted therein. The gate valve is operably connected at one side to the city sewer line and connected at another side with the building sewer line. The gate valve includes a back flow valve which is operable to permit sewage flow only in one direction through the gate valve and in turn through the building sewer line and then to the city sewer line but which back flow valve is physically held in a closed position by any reverse flowing waste fluids to prohibit waste fluids back flowing from the city sewer line into the building and into said gate valve so as to hold the waste fluids and to prevent them from entering the building during flood conditions. The back flow valve is so positioned relative to the gate valve whereby the gate valve is located in the tank but between the back flow valve and the city sewer line permitting the back flow valve to function to shut off the sewage fluids flowing from the city sewer line in the event that the gate valve is left in an open position.

18 Claims, 2 Drawing Sheets

FLOOD CONTROL SYSTEM

FIELD OF INVENTION

The present invention relates generally to a flood control system and more specifically to an apparatus for regulation of sewage flow from a building to a city sewer line and also for inhibiting back flow of waste fluids and sewage from the city sewage line into the building during flood conditions.

In the past, there have been a number of different types of so-called flood control systems and apparatuses, but none of them have performed satisfactorily towards the end of preventing sewage spills into the basements of buildings when city sewage lines are flooded. The past failures of the previously existing flood control systems have come about as a result of incomplete engineering and improper design by the equipment maker and the installer. Based upon my experience, I believe I am the first to provide a new and improved flood control system and/or apparatus where a tank is provided and installed in an underground location housing a gate valve as well as a pump activatable by means of a float type on-off switch. The tank is installed so as to be preferably in an in-line position relative to the sewage line leading from the interior of the building to one side of the tank and then a second sewage line is connected from an opposite side of the tank and telescoped into a pre-existing city sewer line located underneath the footing of the exterior building wall. The city sewer line must be encased in cement beneath the footing to inhibit any back flow of fluids into the basement and/or beneath the footing into underlying regions beneath the basement floor.

Based on my past experiences going over many years, many so-called flood control systems installed in previous years fail because the sewer line underlying the footing is not embedded in concrete and because of the failure to provide a flood control apparatus having the features of my new construction wherein a single tank has both the gate valve and the pump mounted therein and with the tank being installed in an in line position as discussed above. Other prior art systems have been used employing a gate valve and a pump but not in the unique improved arrangement having the improved operating characteristics found in my system or apparatus.

As mentioned above, various types of flood control units have existed before other than the one just described in particular attention is directed to U.S. Pat. No. 3,020,922 issued to Levi I. Oury on Feb. 13, 1962 entitled "Flood Control Unit".

That patentee here discloses a more complicated flood control unit significantly without any gate valve or standpipe and further requiring a weir and a series of compartments in order to control sewage flow through the housing 11 which structures are not found in my unit or apparatus. This type of unit is more costly to manufacture except for the absence of the gate valve and the standpipe found in my system. This prior art is believed to be more difficult to assemble the components of the flood control unit and to install the same in an underground system beneath a basement.

Other less pertinent U.S. Patents known to me generally concerning flood control apparatuses are listed, as follows:

| U.S. Pat. No. | Patent Title | Inventor |
|---|---|---|
| 2,718,238 | Flood Protecting Back Water Trap | A. Simko, Sr. |
| 2,739,662 | Backwater Sewer Trap | A. Sofia |
| 3,115,890 | Flood Control Valve | M. Greenbaum |
| 4,019,304 | Method of Temporarily Water-Proofing Parts of Buildings in Anticipation of Floods | Rolando E. Timm |
| 2,421,066 | Flood Control System | Elra F. Howe |

As I indicated, various disadvantages have been found to exist with the various flood control apparatuses as disclosed above and from other known constructions of which workers in this art are aware.

Based on my recent studies, I have found a number of ways to improve the above-discussed flood control apparatus and the following discussions relates to that subject.

SUMMARY OF THE INVENTION

Figure 1:
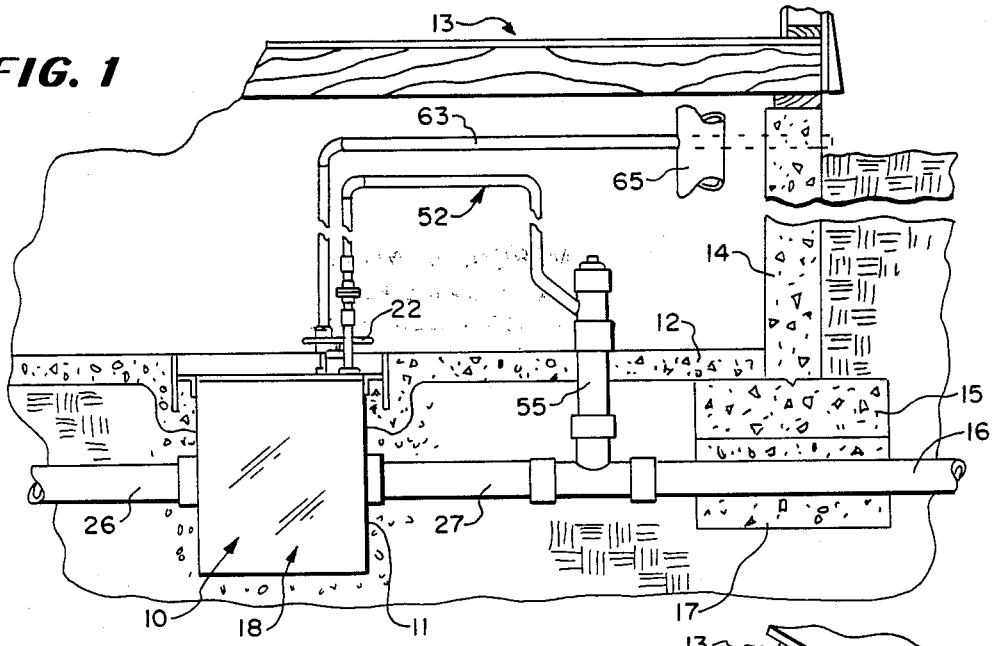
FIG. 1 is an enlarged fragmentary diagrammatic view of a flood control apparatus or system embodying features of my invention.

In a flood control system for use with a building sewer line connected from a building to a city sewer line to prevent back flow of sewage in the line into the building during a flood, the improvement of an underground tank installed in an in-line position with respect to the city sewer line and with at least a portion of the tank lying in a plane below the building sewer line, the city sewer line being cement encased at its point of juncture with a building sewer line beneath the building, the tank having a fluid pump mounted therein and connected by an overhead standpipe for pumping waste fluids from the bottom of the tank back into an inner sewr line for discharge exteriorally to a city sewer line, the tank further having a manually operable gate valve mounted therein, the gate valve being operably connected at one side to the city sewer line and connected at another side with the building sewer line, the gate valve including a back flow valve which is operable to permit sewage flow only in one direction through the gate valve and in turn through the building sewer line and then to the city sewer line but which back flow valve is physically held in a closed position by any reverse flowing waste fluids to prohibit waste fluids back flowing from the city sewer line into the building and into said gate valve so as to hold the waste fluids and to prevent them from entering the building during flood conditions, the back flow valve being so positioned relative to the gate valve whereby the gate valve is located in the tank but between the back flow valve and the city sewer line permitting the back flow valve to function to shut off the sewage fluids flowing from the city sewer line in the event that the gate valve is left in an open position.

According to other features of my invention, the standpipe is connected at one end to the pump in the tank and is operatively connected at an opposite end to the city sewer line for discharging fluids from the tank to the sewer line and a check valve is located in the standpipe for prohibiting the back flow of sewage fluids from the city sewer line into the tank.

According to still other features of my invention, the manually operable gate valve including a wheel which is rotatable for actuation of the valve to open and shut the same, the wheel being connected to a rotary shaft, the rotary shaft having valve member in its lower end for opening and closing the gate valve passageway.

Yet other features of my invention concern the tank having a two-piece lid structure with means securing the lid structure to the tank in a secured assembly therewith, one of the lid halves being free of any projections through the lid half from the interior of the tank, the other of the lid halves having the standpipe and the rotary shaft connected to the wheel extending through the lid.

Still further features of my invention concern a flood control system for use with a building sewer line connected from a building to a city sewer line to prvent back flow of sewage in the line into the building during a flood, the improvement of an underground tank connected to the city sewer line and with at least a portion of the tank lying in a plane below the building sewer line, the city sewer line being cement encased as its point of juncture with the building sewer line beneath the building, the tank having a fluid pump mounted therein and connected by an overhead standpipe for pumping waste fluids from the bottom of the tank back into the interior sewer line for discharge exteriorally to a city sewer line, the tank further having a mutually operable gate valve mounted therein, the gate valve having an internal axially extending gate valve passageway, the valve being secured at an outer wall of the tank and with said passageway being co-axially aligned and operably connected with the city sewer line, the gate valve including a flapper valve mounted in said gate valve passageway which is operable to permit sewage flow only in one direction through the gate valve and in turn through the building sewer line and then to the city sewer but which flapper valve is physically held in a closed position by any reverse flowing waste fluids to prohibit waste fluids back flowing from the city sewer line into the building and into said gate valve so as to hold the waste fluids and to prevent them from entering the building during flood conditions, the flapper valve being so positioned relative to the flapper valve whereby the gate valve is located in the tank but between the flapper valve and the city sewer line permitting the flapper valve to function to shut off the sewage fluids flowing from the city sewer line in the event that the gate valve is left in an open position, the standpipe being connected at one end of said pump in said tank and at an opposite end being operationally connected to the city sewer line for discharging fluids from the tank to the sewer line, and a check valve being located in said standpipe for prohibiting the back flow of sewage fluids from the city sewer line into the tank.

Yet other features of my invention concern the tank having a two-piece lid structure with means securing the lid structure to the tank in a secured assembly therewith, one of the lid halves being free of any projections through the lid half from the interior of the tank, the other of the lid halves having the standpipe and the rotary shaft connected to the wheel extending through the lid.

Still further features of my invention concern a flood control system for use with a building sewer line connected from a building to a city sewer line to prevent back flow of sewage in the line into the building during a flood, the improvement of an underground tank connected to the city sewer line and with at least a portion of the tank lying in a plane below the building sewer line, the city sewer line being cement encased at its point of juncture with the building sewer line beneath the building, the tank having a fluid pump mounted therein and connected by an overhead standpipe for pumping waste fluids from the bottom of the tank back into an interior sewer line for discharge exteriorally to a city sewer line, the tank further having a manually operable gate valve mounted therein, the gate valve having an internal axially extending gate valve passageway, the valve being secured at an outer wall of the tank and with said passageway being co-axially aligned and operably connected with the city sewer line, the gate valve including a flapper valve mounted in said gate valve passageway which is operable to permit sewage flow only in one direction through the gate valve and in turn through the building sewer line and then to the city sewer line but which flapper valve is physically held in a closed position by any reverse flowing waste fluids to prohibit waste fluids back flowing from the city sewer line into the building and into said gate valve so as to hold the waste fluids and to prevent them from entering the building during flood conditions, the flapper valve being so positioned relative to the flapper valve whereby the gate valve is located in the tank but between the flapper valve and the city sewer line permitting the flapper valve to function to shut off the sewage fluids flowing from the city sewer line in the event that the gate valve is left in an open position, the standpipe being connected at one end to said pump in said tank and at an opposite end being operationally connected to the city sewer line for discharging fluids from the tank to the sewer line, and a check valve being located in said standpipe for prohibiting the back flow of sewage fluids from the city sewer line into the tank.

According to still further features of my invention the flapper valve, if it should be corroded or clogged with protein accumulations allowing waste fluid to leak there through whereupon the means for activating the pump can be caused to operate and to turn the pump on and discharge the leaked fluid from a flood back into the city sewer line to prevent sewage from leaking into the building.

Other features of my invention relate to the tank being parallel sided and internally free of baffles, partitions and weirs thus preventing the free flow of sewage floods there through and to leave an internal area of the tank open for ready access for service of the pump and gate valve.

Yet other features of my invention relate to a flood control apparatus for use with a building sewer line connected from a building to a city sewer line to prevent back flow of sewage in the line into the building during a flood including a tank for underground connection to the city sewer line and with at least a portion of the tank being adapted for lying in a plane below the building sewer line, the tank having a fluid pump mounted therein and connected by an overhead standpipe for pumping waste fluids from the bottom of the tank back into the building sewer line for discharge exteriorly to the city sewer line, means for activating the pump should fluid waste accumulation exceed a predetermined level, the tank further having a manually operable gate valve mounted therein, the gate valve having an internal axially extending gate valve passageway for cutting off fluid flow into the passageway from either direction, the valve being secured to an outer side wall of the tank and with said passageway being co-axially aligned with a tank opening in the outer wall of the tank and further being adapted for operable connection to a sewer line which in turn is operably connected to the city sewer line, the gate valve including a flapper valve mounted in said gate valve passageway, the flapper valve being so positioned relative to the gate valve whereby the gate valve is located in the gate valve passageway but between the flapper valve and the city sewer line with the flapper valve being structurally oriented to shut off the sewage fluids flowing from the city sewer line in the event that the gate valve is left in an open position, the sewage flow only being permitted in one direction through the flapper valve past the gate valve when open and in turn through the building sewer line and then to the city sewer line but which flapper valve is physically held in a closed position by any reverse flowing waste fluids to prohibit waste fluids back flowing from the city sewer line into the building during flood conditions, the standpipe being connected at one end to said pump in said tank and at an opposite end being operatively connected to the sewer line for discharging fluids from the tank to the sewer line, and a check valve being located in said standpipe for prohibiting the back flow of sewage fluids from a city sewer line into the tank.

DESCRIPTION OF THE PREFERRED EMBODIMENTS

Figure 2:
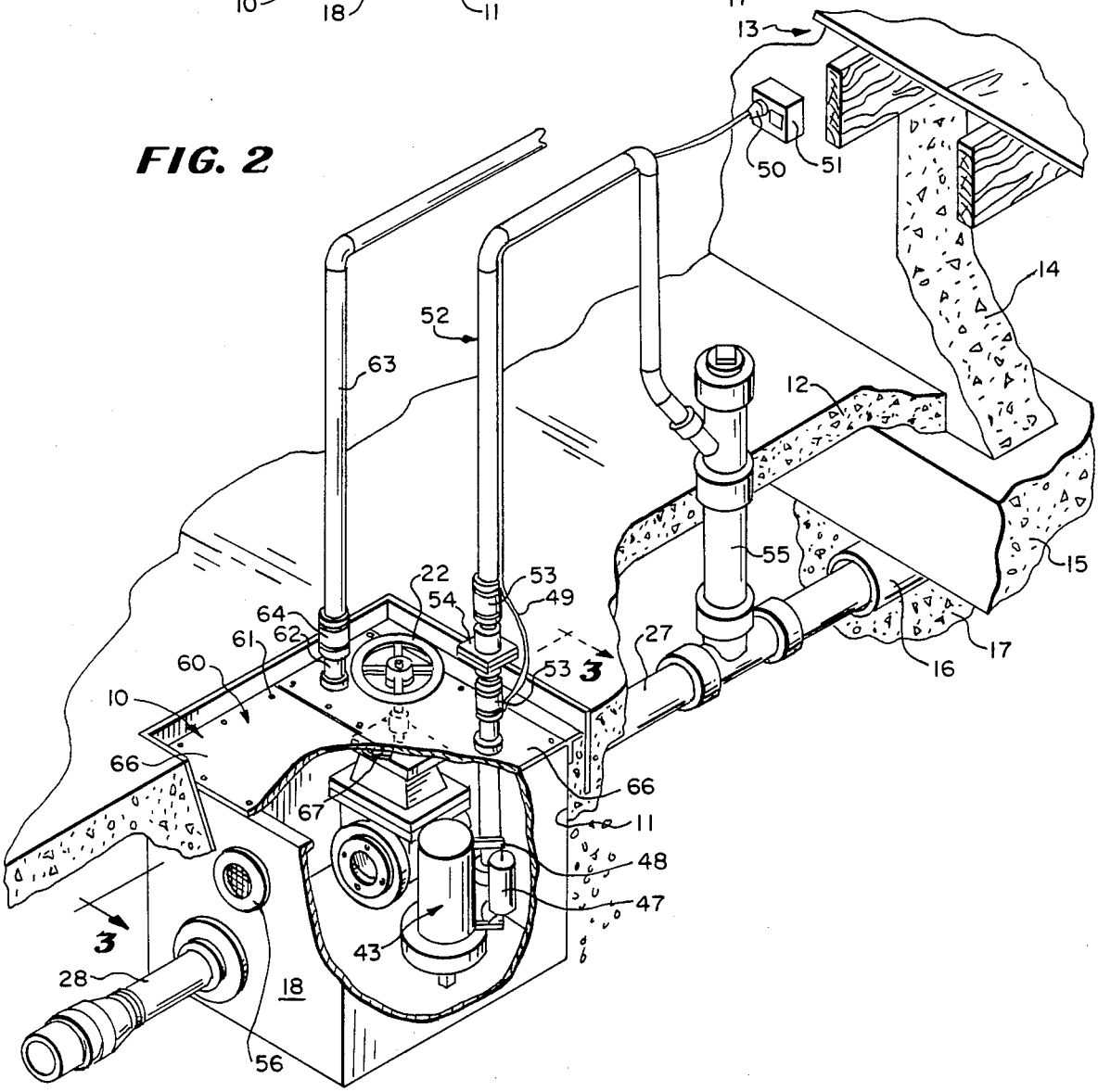
FIG. 2 is an enlarged fragmentary diagrammatic prospective view of the flood control system of FIG. 2 with various parts broken away for the purpose of illustrating various features including the interior of an underground tank.
Figure 3:
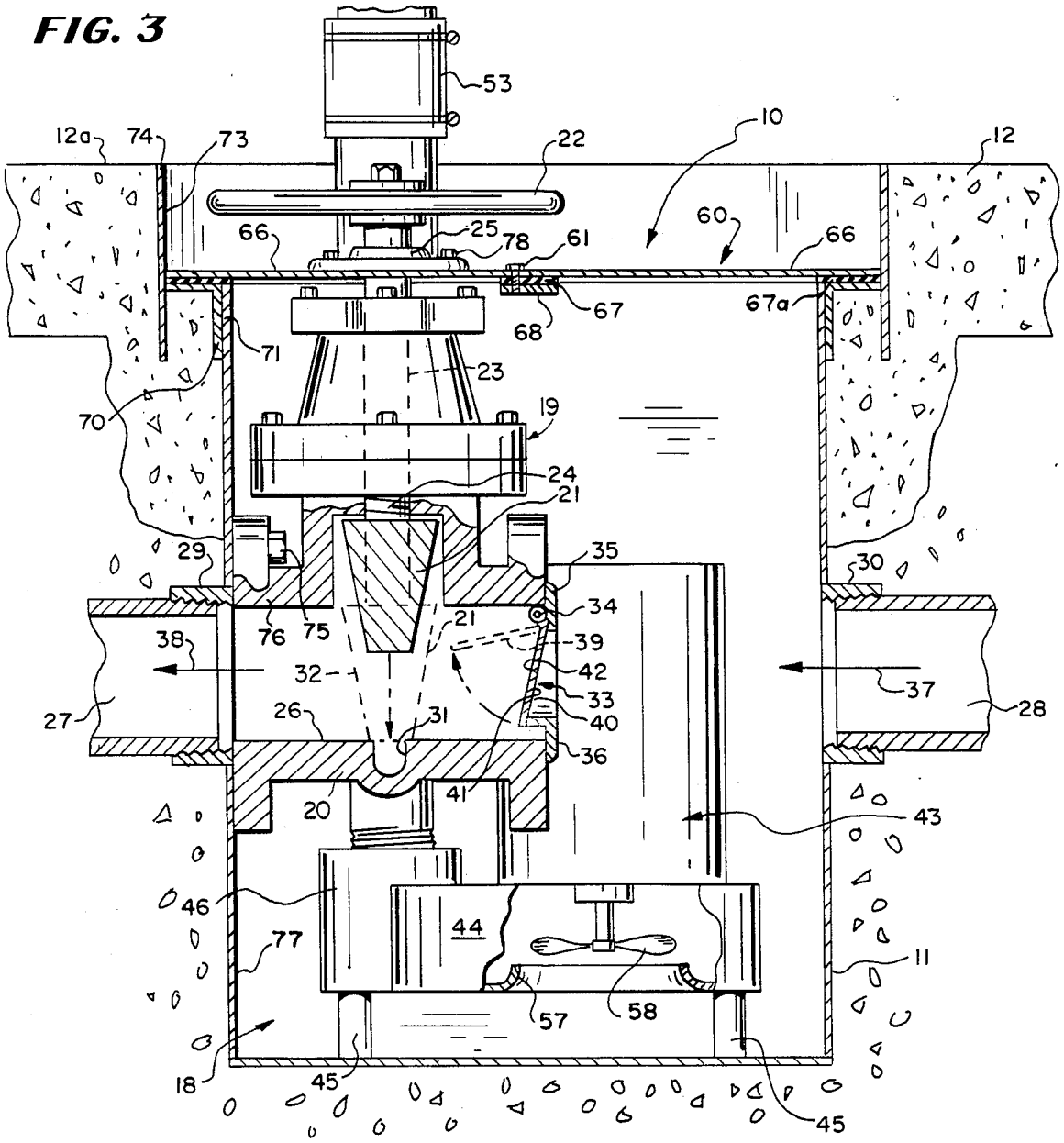
FIG. 3 is a vertical section taken on the line 3—3 looking in the direction indicated by the arrows as seen in FIG. 2.

The reference numeral 10 indicates generally a flood control system or apparatus for installation in a hole 11 in a cement basement floor 12 contained in a building 13. The building 13 has an exterior building wall 14 that is carried on a cement foundation 15. A cast iron city sewer pipe or line 16 is encased in cement 17 as the line 16 extends under the cement foundation 15 at the area which the exterior vertical building wall 14 merges with the foundation 15 in accordance with certain important features of my invention. This sewer line 16 extends beneath the cement foundation 15 into the underneath above the basement floor as seen in FIG. 2 where it is connected to other sewer lines hereafter discussed.

Where the flood control apparatus 10 is to be installed in an existing residence or building, it is necessary that the hole 11 be cut in the cement basement floor. After the hole has been cut, an underground tank 18 is installed in an in-line position with respect to the sewer line 16. When installed, it will be observed that at least a portion of the tank lies in a plane below the interior sewer line 16 as seen in FIG. 1–3. The tank is preferably made from a suitable steel such as 3/16" thick, and can be plastic or epoxy coated to minimize rust. The tank may also be made from fiberglass if desired.

According to features of my invention, a manually operable gate valve 19 is mounted interiorally of the tank 18. The gate valve 19 includes a housing 20 for encasing the components of the valve. A tapered valve member 21 is mounted in the housing. A manually operable wheel or handle 22 is connected to a valve actuating shaft 23 at its upper end. The valve actuating shaft 23 has threads 24 provided at a lower end thereof securing the shaft 23 to the tapered valve member 21. As indicated in FIG. 3, the shaft 23 is mounted in a suitable bearing 25 to permit the wheel 22 and the valve member 21 to be freely rotated within the housing 20.

The gave valve 19 has a horizontal sewage valve passageway 26 provided therein. As is seen in FIG. 3, the gate valve 19 is so mounted within the tank to permit the sewage passageway 26 to be co-axially aligned with interior cast iron sewage pipe lines 27 and 28 located at opposite sides of the tank 18. The sewage pipe lines 27 and 28 may be secured by quick connect couplings (not-shown) to threaded tank flanges 29–30 which flanges are welded at opposite sides of the tank to permit disconnect threaded connectionof the pipes threaded or passageways 27 and 28 with the tank flanges 29–30 on the tank 18. The sewage pipe lines 27 and 28 along with the city sewage line 16 are all pitched at ¼" per foot with the high end of the pipe being beneath and building and with the low end of the pipe being where the city sewer line exists the building and then it continues with its downward pitch to the point where it enters into the main sewer system.

The passageway 26 has a sump 31 mounted in vertically spaced relation with the valve member 21 when the valve member 21 is in its up position as shown in FIG. 3. The valve member 21 is movable from its up position as shown by the full lines to its closed position as shown by the dotted lines at 32. The valve 21, when in its closed position, rests against the interior wall of the passageway 26 in overlying relation to the sump 31. As the valve member 21 is moved against the interior wall of the passageway 26, any material that may be accumulated along the bottom wall of the passageway at the area of the sump 31, can be sheered or forced into the sump so that the valve member 21 can move in a relatively unimpeded manner into snug sealed engaged position against the interior wall of the passageway 26 to shut off sewage flow through the passageway 26.

Should the building owner or the homeowner forget to close the passageway or the gate valve 19 during a time when the outside fluid line or sewer line 16 is flooded, a flapper valve or back flow valve 33 is mounted in pivoted aligned assembly with the passageway 26 on the housing 20. The pivot for the flapper valve is shown at 34 (FIG. 3). The flapper valve has ends 35 and 36 which are adapted to be positioned in lapped relation to form a closure with the housing 20 to close off the passageway 26.

The sewage flow (FIG. 3) from the flooded sewer line is in a direction opposite to the direction opposite to the direction of arrows 37 and 38. The arrows 37 and 38 show the way in which the sewage normally flows from in the building in the tank 18 and then out of the tank into the sewer line 16. Should the sewage flow be reversed due to a flooded condition in the sewage line, then the flapper valve 33 would operate in its full line shown in FIG. 3 to close off the sewage flow to prohibit the sewage from discharging into the sump or housing 20. The dotted line position 39 of the flapper valve 33 shows the position of the valve when it is in an open position to permit sewage from inside the building to flow through the gate valve 19.

The flapper valve or back flow valve 33 is preferably of a brass composition and includes a pivotal or swingable flapper valve member or plate 40 which is of a circular configuration. The plate 40 is positioned at a 22° angle relative to the horizontal axis or the gate valve passageway 26. This valve member 40 has an inner annular valve face 41 which is adapted to co-act with an annular fixed valve face 42 for snug leak proof enagagement when the faces 41 and 42 are in abutment. The valve member 40 is held shut by the force of gravity and its normal weight when the sewage flow from the building fails to generate enough pressure to force the valve member 40 from its closed (full line) position it its (open line) position 32 as seen in FIG. 3.

An important objective of my invention is to provide a flood control apparatus or system that can prevent sewage from coming into the basement when it rises in the storm sewer or in the city sewer lines. To accomplish this end, we use the gate valve 19 and a pit and a pump 43 in the summer in the rainy season. The gate valve 19 can be opened in wintertime if desired, and if the pump 43 fails or it needs a new switch or a new pump, the valve 19 can be opened to permit sewage to flow direct through the valve passageway 26 into the city sewer line. Now the copper tubing or standpipe 52 is extended vertically and then is return bent and connected to the sewer pipe 55 to prohibit a reverse flow of sewage from the city sewer line into the basement. It has been my experience that all sewers leak including those that come into the basement of buildings and it is therefore an important objective here to prevent the sewage from coming into the basement. Should sewage come into the basement, the tank is provided with a screened seepage hole 56 positioned above the sewer pipe 18 so that when the level of sewage rises to a point sufficient to cause the pump to run, the pump will then pump this sewage out of the tank into the city sewer line and thereby maintain the bottom of the basement floor dryer all year around. It will be noted that the seepage hole is located beneath the basement floor and hence it is contemplated that the sewage fluids that may enter the seepage hole would enter from a point externally of the basement under normal circumstances. Thus, if the sewer line 16 leaked or if there was a crack in the basement wall 14, the water and/or sewage could flow into the seepage hole 56 and be discharged by the pump back into the sewer line as previously described.

Also mounted inside of the tank 18 is a fluid pump 43. The pump 43 has a pump base 44 supported on pump base legs 45—45 on the bottom of the tank 18. The outlet of the pump 43 is shown at 46 (FIG. 3).

The pump 43 has a float 47 that is movable up and down vertically in accordance with the sewage fluid level in the tank 18. As the float 47 rises, it activates a switch arm 48 to cause the pump to be electrically activated. Should the flapper valve 33 not close in its entirety, it is possible that some waste fluids may flow through the flapper valve from the city sewer line during a flood condition particularly where the valve becomes corroded or where waste bacteria and protein may accumulate on the faces of the flapper valve which would otherwise when free of such accumulations form a tight seal. In the event that such a leakage should occur through the flapper valve 33, and after the fluids would accumulate in the tank to a sufficient level, the float valve 47 would activate the pump's switch lever on 48 to cause the pump to commence operation and to pump out the fluids through the standpipe 52, then through the upright sewer pipe 55 through the T connection of the lne 55 with the line 27 and then into the city sewer line 16. It will be seen that the pump 43 is connected by an electrical line 49 and has a plug 50 that is plugged into a electrical wall socket 51 on an interior face of the exterior building wall 14 (FIG. 2). When the pump is activated, the fluid in the tank 18 is drawn into the pump and caused to be discharged through the outlet 46 through a standpipe line 52. From a review of FIG. 2, it will be seen that the standpipe 52 is generally of a U-shaped configuration and has a pair of rubber connectors 53—53 which serve to enable segments of the standpipe to be quickly connected together to service the pump or check valve 54. Between the rubber connectors 53—53 is the check valve 54 which serves to prevent sewage flow through the sewer line 16 into the sewage pipe 27 vertically through the sewer pipe 55 and then into the standpipe 52 when a flooded condition exists in the city sewage system outside the building. Thus, the flapper valve or back flow valve 33 and the check valve 54 both co-act to prevent sewage from flowing from a flooded sewer line outside of the building back into the basement so as to flood the basement. Should any sewage flow into the tank sufficient to activate the float valve, the fluid would enter pump inlet 56. The revolving pump impeller 58 would then pump the fluid out the outlet 46.

It will be further seen in FIG. 2 that the tank 18 has a split lid structure 60 mounted thereon. The lid 60 is screwed in place by screws 61. Connecterd to the lid structure is an exhaust or vent pipe 62. A second exhaust or vent pipe 63 is coupled to the exhaust pipe 62 by a rubber connector 64. The exhaust or vent pipe 63 is in turn connected to a vertical exhaust pipe 65 (FIG. 1) which vents the tank 18 to the exterior of the building. Thus the pipes 62, 63 and 65 co-act to vent the tank. The lid structure is split into lid halves 66—66 with all of the pipe penetrating one lid half and with the other lid half being left unencumbered so that is can be readily removed to provide access to the interior of the tank 18 for service. The screws 61 serve to secure the lid halves to over one another along a line where they are annular flange lapped and at outer edges of the lid halves where they engage on tank angle 70. Synthetic gaskets 67 are interposed between the lid and its junctures with the tank. This gasket 67 also co-acts with a metallic strap 68 and the screws 61 to permit the halves 66—66 to be securely attached together.

As it will be noted in FIG. 3, the lid 60 is mounted on the annular flange 70 that is welded at 71 to the side of the tank. Since the tank 18 is four sided, the flange 70 is also similarly shaped, and the lid structure 60 is also parallel sided.

In the assembly of the manually operable gate valve 19 in the tank 18 it will be seen that the valve housing is located so that the axial valve passageway 26 is positioned co-axially of the sewer line 27. At this juncture, threaded bolts 75 are used to secure valve housing 76 against a tank sidewall 77. It will further be seen that the gate valve housing 76 at its upper end, is secured by bolts 78 or other suitable fasteners to the lid 60.

When the tank 18 is installed in place, the hole 11 must be dug sufficiently deep so that the pipe lines 27 and 28 can be aligned with the openings in the opposite confronting sides of the tank. After the pipes 27 and 28 have been secured by couplings to the flanges provided on the tank, a square sided sleeve 73 can be engaged over an outer edge of the lid structure 60 and the sleeve can be pushed vertically downward until the upper edge 74 of the sleeve is flush with the top surface 12*a* of the cement basement floor 12. After the tank 18 has been assembled in the pit that has been excavated out of the basement floor, the open areas at the perimeter of the pit can be filled with gravel as indicated in FIG. 3, and new cement can be poured into the cavity to close the basement floor 12 so that no openings are to be found therein.

The manually operable gate valve 19 is an industrial type valve that can be of a 4" type. It has a 125 lb. per square inch woring pressure. This type of valve is a gate valve that has a full opening when in an open position so that the effluvient can pass through the passageway 26 to the full extent of the 4" diameter of the sewage passageway 26. The gate valve 19 is one that is radilly actuable and movable relative to the axis of the horizontal passageway through the valve. As the gate valve 19 is moved radially with the turning of the handle because of the tapered valve construction of the valve member a shearig effect is generated as the valve member is caused to move transversely or radially across the passageway into operating engagement with the tapered sealing surfaces of the valve body. To this end, should any material accumulate which might impede the action of the valve member, because of the mechanical advantages that are developed through the screw action as the valve member is caused to move radially into a closed position a shearing effect occurs and any refuse is thereby sheared and caused to move either laterally of the valve member or into the sump area marked at 31 in FIG. 3.

The old type of flood control system known to me to have been used in earlier years is my work utilized a gate valve located outside of a sewer ejector pit or pump tank as contrasted to my prevent invention. In my new flood control system, as shown in the drawings, and as further described herein, the gate valve 19 is installed internally of the pit and with a flapper valve 33 according to other features of my invention. This arrangement simplified the installation of the flood control apparatus and also provides access to the apparatus for purpose of repair and inspection. With my new flood control system, it is now possible for the first time to eliminate the additional pipe lines that were required to service the old type of flood control system thus reducing the cost. Still further, a number of fittings can be eliminated that were required on the old flood control system. Still further, the amount of excavation required to complete an installation can be materially reduced thereby minimizing the cost of installing the new flood control system as opposed to the old one.

Still another important advantage of my new flood control apparatus relates to the way that the flood control apparatus can be serviced. By locating the important components of the flood control apparatus all in a common tank rather than at separate underground placements, it is easier for the unit to be examined for malfunction and for service.

As previously disclosed, the flapper valve operates to prevent the back flow of material from the sewer line back into the reservoir or tank. The flapper valve is non-functional when the gate valve is closed simply because the gate valve, of course, handles the back flow but the flapper there allows the system to function as though the gate valve were closed in the event of a rush of water, flood or some overflow of the sewer system from coming back into the house, and the owner of the house had forgotten to close the gate valve.

With the flood control systems that were previously available and installed by me for a number of years, the underground pipes required extra diverting fittings and pipe lines that had to be installed from the pump for the purpose of permitting the pump discharge to be conveyed through the pipe line into the main sewer line downstream of the gate valve. With the prior construction, much more excavation was necessary, and a greater amount of floor patching was required and also the area in the basement has to be greater to allow the old system to be installed as opposed to the new system. According to my invention, the new sytem basically requires breaking into the main sewer line of the house and introducing one end of the sewer line into the tank or reservoir. In the reservoir we have the pump, the tank, the vent lines, and the flapper valve. The other side of the tank or reservoir is connected with the other end of the broken sewer line. In view of the simplicity of my new flood control apparatus and system, it is not possible that a "do it yourselfer" can make the installation himself.

It is thus seen, therefore, that there is provided an improved apparatus and/or system in which the objects of the invention are achieved and which are well adapted to meet all conditions of practical use.

As various possible embodiments may be made in the above invention for use for different purpose and as various changes might be made in the embodiments and method above set forth, it is understood that all of the above matters here set forth or shown in the accompanying drawings are to be interpreted as illustrative and not in a limiting sense.

I claim:

1. In a flood control system for use with a building sewer line connected from a building to a city sewer line to prevent back flow of sewage in the line into the building during a flood, the improvement of an underground tank installed in an in-line position with respect to the city sewer line and with at least a portion of the tank lying in a plane below the buliding sewer line, the city sewer line being cement encased at its point of juncture with the building sewer line beneath the building, the tank having a fluid pump mounted therein and connected by an overhead standpipe for pumping waste fluids from the bottom of the tank back into an inner sewer line for discharge exteriorally to a city sewer line, the tank furhter having a manually operable gate valve mounted therein, the gave valve being operably connected at one side to the city sewer line and connected to another side with the building sewer line, the gave valve including a back flow valve which is operable to permit sewage flow only in one direction through the gate valve and in turn through the building sewer line and then to the city sewer line but which back flow valve is physically held in a closed position by any reverse flowing waste fluids to prohibit waste fluids back flowing from the cit sewer line into the building and into said gate valve so as to hold the waste fluids and to prevent them from entering the building during flood conditions, the back flow valve being so positioned relative to the gate valve whereby the gate valve is located in the tank but between the back flow valve and the city sewer line permittig the back flow valve to function to shut off the sewage fluids flowing from the city sewer line in the event that the gate valve is left in an open position.

2. The flood control system of claim 1 further characterized by the standpipe being connected at one end of said pump in said tank and being operatively connected at an opposite end to the city sewer line for discharging fluids from the tank to the sewer line, and a check valve being located in said standpipe for prohibiting the back flow of sewage fluids from the city sewer line into the tank.

3. The flood control system of claim 1 further characterized by the manually operable gate valve including a wheel which is rotatable for actuation of the valve to open and shut the same, the wheel being connected to a rotary shaft, the rotary shaft having a valve member at its lower end for opening and closing the gate valve passageway.

4. The flood control system of claim 3 further characterized by the tank having a two piece lid structure, means securing the lid structure to the tank in secured assembly therewith, one of the lid halves being free of any projections through the lid half from the interior of the tank, the other of the lid halves having the standpipe and the rotary shaft connected to the wheel extending through the lid half.

5. In a flood control system for use with a building sewer line connected from a building to a city sewer line to prevent back flow of sewage in the line into the building during a flood, the improvement of an underground tank connected to the city sewer line and with at least a portion of the tank lying in a plane below the building sewer line, the city sewer line being cement encased at its point of juncture with the building sewer line beneath the building, the tank having a fluid pump mounted therein and connected by an overhead standpipe for pumping waste fluids from the bottom of the tank back into an interior sewer line for discharge exteriorally to a city sewer line, the tank further having a manually operable gate valve mounted therein, the gate valve having an internal axially extending gate valve passageway, the valve being secured at an outer wall of the tank and with said passageway being co-axially aligned and operably connected with the city sewer line, the gate valve including a flapper valve mounted in said gate valve passageway which is operable to permit sewage flow only in one direction through the gate valve and in turn through the building sewer line and then to the city sewer line but which flapper valve is physically held in a closed position by any reverse flowing waste fluids to prohibit waste fluids back flowing from the city sewer line into the building and into said gate valve so as to hold the waste fluids and to prevent them from entering the building during flood conditions, the flapper valve being so positioned relative to the gate valve whereby the gate valve is located in the tank but between the flapper valve and the city sewer line permitting the flapper valve to function to shut off the sewage fluids flowing from the city sewer line in the event that the gate valve is left in an open position, the standpipe being connected at one end to said pump in said tank and at an opposite end being operationally connected to the city sewer line for discharging fluids from the tank to the sewer line, and a check valve being located in said standpipe for prohibiting the back flow of sewage fluids from the city sewer line into the tank.

6. The flood control system of claim 5 further characterized by the manually operable gate valve including a wheel which is rotatable for actuation of the valve to open and shut the same, the wheel being connected to a rotary shaft, the rotary shaft having a valve member at its lower end for opening and closing the gate valve passageway.

7. The flood control system of claim 6 further characterized by the tank having a two piece lid structure, means securing the lid structure to the tank in secured assembly therewith, one of the lid halves being free of any projections through the lid half from the interior of the tank, the other of the lid halves having the standpipe and the rotary valve actuating shaft connected to the wheel and extended through the lid half.

8. The flood control system of claim 5 further characterized by fastener means connecting the manually operable gave valve to said tank in such a way as to maintain the valve passageway in direct co-axial alignment with an interior sewer line for discharging sewage fluids from the building into the city sewer line.

9. The flood control system of claim 5 further characterized by said gate valve having a movable gate valve member movable at right angles to said valve passageway, said flapper valve having a pivotal flapper valve plate axially confronting the movable gate valve member and being swingable in said valve passageway for allowing sewage flow only in one direction.

10. The flood control system of claim 5 further characterized the tank being parallel sided and internally free of baffles, partitions and weirs thus preventing the free flow of sewage floods there through to leave an internal area of the tank open for ready access for service of the pump and the gave valve.

11. The flood control system of claim 5 further characterized by the flapper valve including a swingable flapper plate which is disposed at a 22° angle relative to the horizontal axis of te gate valve passageway.

12. A flood control apparatus for use with a building sewer line connected from a building to a city sewer line to prevent back flow of sewage in the line into the building during a flood including a tank for underground connection to the city sewer line and with at least a portion of the tank being adapted for lying in a plane below the building sewer line, the tank having a fluid pump mounted therein and connected by an overhead standpipe for pumping waste fluids from the bottom of the tank back into the building sewer line for discharge exteriorly to the city sewer line, means for activating the pump should fluid waste accumulation exceed a predetermined level, the tank further having a manually operable gate valve mounted therein, the gate valve having an internal axially extending gate valve passageway for cutting off fluid flow into the passageway from either direction, the valve being secured to an outer side wall of the tank and with said passageway being co-axially aligned with a tank opening in the outer wall of the tank and further being adapted for operable connection to a sewer line which in turn is operably connected to the city sewer line, the gate valve including a flapper valve mounted in said gate valve passageway, the flapper valve being so positioned relative to the gate valve whereby the gate valve is located in the gate valve passageway but between the flapper valve and the city sewer line with the flapper valve being structurally oriented to shut off the sewage fluids flowing from the city sewer line in the event that the gate valve is left in an open position, the sewage flow only being permitted in one direction through the flapper valve past the gate valve when open and in turn through the building sewer line and then to the city sewer line but which flapper valve is physically held in a closed position by any reverse flowing waste fluids to prohibit waste fluids back flowing from the city sewer line into the building during flood conditions, the standpipe being connected at one end to said pump in said tank and at an opposite end being operatively connected to the sewer line for discharging fluids from the tank to the sewer line, and a check valve being located in said standpipe for prohibiting the back flow of sewage fluids from a city sewer line into the tank.

13. The flood control apparatus of claim 12 further characterized by the manually operable gate valve including a wheel which is rotatable for actuation of the valve to open and shut the same, the wheel being connected to a rotary shaft, the rotary shaft having a valve member at its lower end for opening and closing the gate valve passageway.

14. The flood control apparatus of claim 12 further characterized by the tank having a two piece lid structure, means securing the lid structure to the tank in secured assembly therewith, one of the lid halves being free of any projections through the lid half from the interior of the tank, the other of the lid halves the standpipe and a rotary valve actuating shaft connected to gate valve extended through the lid half.

15. The flood control apparatus of claim 12 further characterized by fastener means connecting the manually operable gate valve to said tank in such a way as to maintain the valve passageway in direct co-axial alignment with the interior sewer line for discharging sewage fluids from the building into the city sewer line.

16. The flood control apparatus of claim 12 further characterized by said gate valve having a movable gate valve member movable at right angles to said valve passageway, said flapper valve having a pivotal flapper valve plate axially confronting the movable gate valve member and being swingable in said valve passageway for allowing sewage flow only in one direction.

17. The flood control apparatus of claim 12 further characterized by the tank being parallel sided and internally free of baffles, partitions and weirs thus preventing the free flow of sewage floods there through to leave an internal area of the tank open for ready access for service of the pump and the gate valve.

18. The flood control valve of claim 12 further characterized by said means for activating the pump being operable to turn the pump on and discharge any leaked fluid from a flood back into a sewer line to prevent sewage from leaking into the building should the flapper valve become corroded or clogged with protein accumulations allowing waste to leak there through.

* * * * *